United States Patent [19]

Lathers

[11] Patent Number: 4,919,068

[45] Date of Patent: Apr. 24, 1990

[54] RECREATIONAL BOAT SOFA/SLEEPER

[75] Inventor: Michael W. Lathers, Metamora, Mich.

[73] Assignee: Outboard Marine Corporation, Waukegan, Ill.

[21] Appl. No.: 216,791

[22] Filed: Jul. 8, 1988

[51] Int. Cl.[5] ..... B63B 17/00

[52] U.S. Cl. ..... 114/363; 5/28; 296/69; 297/108

[58] Field of Search ..... 114/363, 357; 5/28, 5/29; 296/69; 297/108

[56] References Cited

U.S. PATENT DOCUMENTS

| | | | |
|---|---|---|---|
| 4,703 | 8/1846 | Needham . | |
| 200,845 | 3/1878 | Richter . | |
| 209,019 | 10/1878 | Carter . | |
| 319,491 | 6/1885 | King . | |
| 382,743 | 5/1888 | Waldo . | |
| 907,311 | 12/1908 | Bowdon . | |
| 2,787,315 | 4/1957 | Siebert | 114/363 |
| 2,993,529 | 7/1961 | Brown | 114/363 X |
| 3,246,347 | 4/1966 | Mason | 296/69 X |
| 3,376,587 | 4/1968 | Staron | 114/363 |
| 3,634,898 | 1/1972 | Geiger | 114/357 |

FOREIGN PATENT DOCUMENTS

| | | | |
|---|---|---|---|
| 1349551 | 12/1963 | France | 5/28 |
| 393129 | 6/1933 | United Kingdom | 155/49 |

*Primary Examiner*—Sherman D. Basinger

*Attorney, Agent, or Firm*—Michael, Best & Friedrich

[57] ABSTRACT

A marine vehicle comprising a hull, a floor supported by the hull, and a convertible sofa-sleeper supported by the floor and including a seat bottom member having a forward end and being supported for movement between a horizontal position wherein the seat bottom member extends substantially horizontally, and a canted position wherein the seat bottom member is inclined upwardly toward the forward end.

15 Claims, 2 Drawing Sheets

RECREATIONAL BOAT SOFA/SLEEPER

RELATED APPLICATION

Attention is directed to U.S. Ser. No. 216,889, filed concurrently herewith titled "RECREATIONAL BOAT DINETTE/SLEEPER" and assigned to the assignee hereof.

BACKGROUND OF THE INVENTION

The invention relates to recreational boats, and, more particularly, to cabin furniture for such boats. Still more particularly, the invention relates to convertible sofa/-sleepers for recreational boats.

Known convertible sofa/sleepers have seat bottom members that are always horizontal. This may be uncomfortable for a person sitting on the horizontal seat bottom member, as the person may tend to slide forwardly off the seat bottom member.

SUMMARY OF THE INVENTION

The invention provides a marine vehicle comprising a hull, a floor supported by the hull, and a convertible sofa-sleeper supported by the floor and including a seat bottom member having a forward end, and means supporting the seat bottom member for movement between a horizontal position wherein the seat bottom member extends substantially horizontally, and a canted position wherein the seat bottom member is inclined upwardly toward the forward end.

The invention also provides a convertible sofa/-sleeper comprising a seat bottom member having a forward end, and means supporting the seat bottom member for movement between a horizontal position wherein the seat bottom member extends substantially horizontally, and a canted position wherein the seat bottom member is inclined upwardly toward the forward end.

In one embodiment, the forward end of the seat bottom member is adapted to rest on a supporting surface, and the means supporting the seat bottom member includes means selectively and alternatively operable for permitting the forward end to rest on the supporting surface and for supporting the forward end above the supporting surface.

In one embodiment, the selectively operable means includes a support member located at least partially beneath the forward end of the seat bottom member and movable between a first position wherein the forward end of the seat bottom member rests on the supporting surface, and a second position wherein the support member rests on the supporting surface and the forward end of the seat bottom member rests on the support member.

In one embodiment, the support member is mounted on the seat bottom member for pivotal movement between the first and second positions.

In one embodiment, the seat bottom member has an underside and the support member is pivotally connected to the underside of the seat bottom member.

In one embodiment, the sofa/sleeper further comprises an extension member having inner and outer ends, and the inner end of the extension member is pivotally connected to the forward end of the seat bottom member for pivotal movement between a folded position wherein the extension member rests on the upper surface of the seat bottom member, and an extended position wherein the extension member extends outwardly from the forward end of the seat bottom member and is substantially coplanar with the seat bottom member.

In one embodiment, the sofa/sleeper further comprises a retractable leg for supporting the extension member in the extended position.

In one embodiment, the sofa/sleeper further comprises a cover member suspended from the inner end of the extension member.

In one embodiment, the seat bottom member also has a rearward end, and the sofa/sleeper also comprises a seat back member located adjacent the rearward end.

A principal feature of the invention is the provision of a convertible sofa/sleeper comprising means supporting a seat bottom member for movement between a horizontal position wherein the seat bottom member extends substantially horizontally, and a canted position wherein the seat bottom member is inclined upwardly toward its forward end. When the sofa/sleeper is being used as a sleeper, the seat bottom member is placed in its horizontal position to provide a horizontal sleeping surface. When the sofa/sleeper is being used as a sofa, the seat bottom member is placed in its canted position in order to prevent a person sitting on the seat bottom from sliding forwardly off the seat bottom member.

Other features and advantages of the invention will become apparent to those skilled in the art upon review of the following detailed description, claims and drawings.

Figure 1:
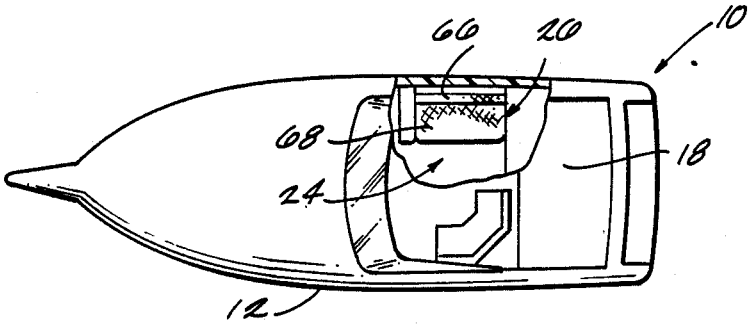
FIG. 1 is a top plan view of a recreational boat including a convertible sofa/sleeper embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Figure 2:
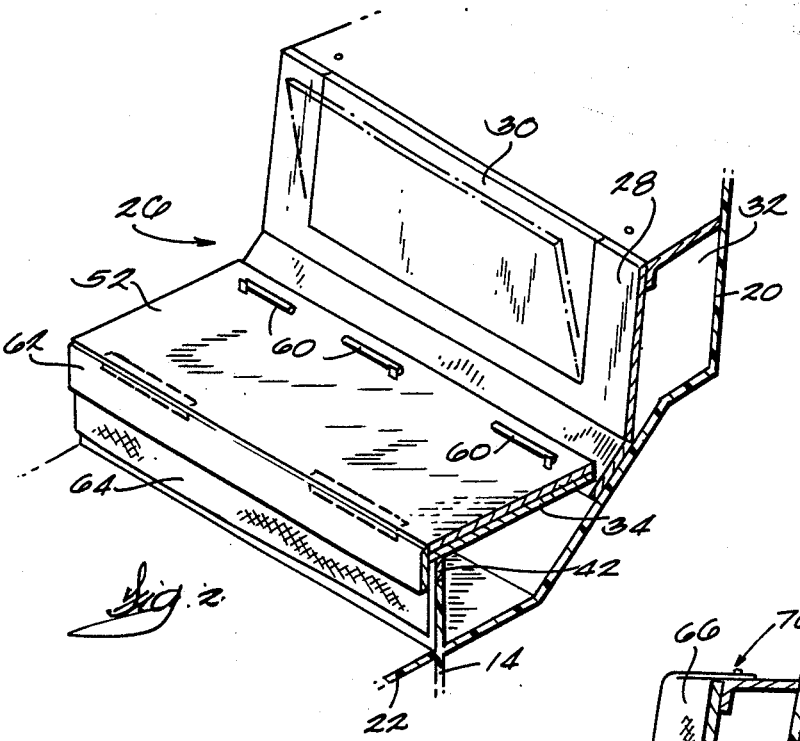
FIG. 2 is a perspective view of the sofa/sleeper without cushions.

A recreational boat or marine vehicle 10 embodying the invention is illustrated in the drawings. The boat 10 comprises a hull 12, and a plurality of hull stringers 14 (see FIG. 3) extending upwardly from and supporting the hull 12. The upper end of one of the hull stringers 14 defines (see FIG. 5) a supporting surface 16. The boat 10 also comprises a top deck member 18 (FIG. 1), a cabin wall 20 (FIGS. 2–4) and a cabin floor 22 (FIGS. 2–4) defining a cabin 24.

The boat 10 also comprises a convertible sofa/sleeper 26 located in the cabin 24. The sofa/sleeper 26 comprises a generally vertical seat back member 28 having upper and lower ends. In the illustrated construction, the seat back member 28 has therein (see FIG. 2) a door 30 providing access to a storage compartment 32 defined between the seat back member 28 and the cabin wall 20. The sofa/sleeper 26 also comprises a seat bottom member 34 having forward and rearward ends 36 and 38, respectively, and an underside 40. The forward end 36 of the seat bottom member 34 is adapted to rest on the supporting surface 16. The rearward end 38 of the seat bottom member 34 is located adjacent the lower end of the seat back member 28. Alternatively stated, the seat back member 28 is located adjacent the rearward end 38 of the seat bottom member 34.

Figure 5:
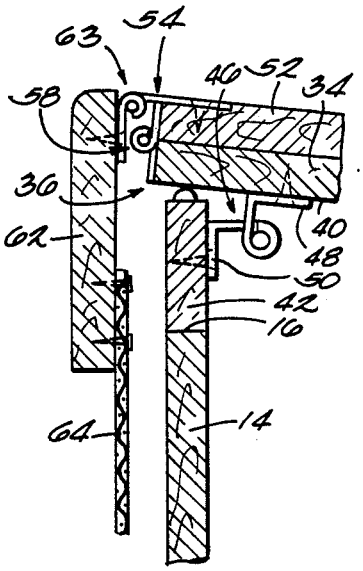
FIG. 5 is an enlarged, partial view of the sofa/sleeper as shown in FIG. 3.

The sofa/sleeper 26 also comprises means 41 supporting the seat bottom member 34 for movement between a horizontal position (shown in FIG. 4) wherein the seat bottom member 34 extends substantially horizontally, and a canted position (shown in FIG. 3) wherein in the seat bottom member 34 is inclined upwardly toward its forward end 36. While various suitable supporting means 41 can be employed, in the preferred embodiment, the means 41 includes a flipper board or support member 42 located beneath the forward end 36 of the seat bottom member 34. Preferably, the flipper board 42 is an elongated board having a length substantially equal to the width of the seat bottom member 34. The means 41 supporting the seat bottom member 34 also includes means 44 supporting the flipper board or support member 42 for movement between a first position (shown in FIG. 4) wherein the flipper board 42 permits the seat bottom member 34 to rest on the supporting surface 16 so that the seat bottom member 34 is in its horizontal position, and a second position (shown in FIGS. 3 and 5) wherein the flipper board 42 rests on the supporting surface 16 and the forward end 36 of the seat bottom member 34 rests on the flipper board 42 so that the seat bottom member 34 is in its canted position. While various suitable means 44 can be used, in the illustrated construction, the flipper board 42 is pivotally connected to the underside 40 of the seat bottom member 34 by hinge apparatus 46. As best shown in FIG. 5, the hinge apparatus 46 includes a first L-shaped hinge plate 48 fixedly secured to the underside 40 of the seat bottom member 34 and a second L-shaped hinge plate 50 fixedly secured to the support member or flipper board 42.

The sofa/sleeper 26 further comprises an extension member 52 which is substantially identical in size to the seat bottom member 34 and which has inner and outer ends 54 and 56, respectively. The inner end 54 of the extension member 52 is pivotally connected to the forward end 36 of the seat bottom member 34 for pivotal movement between a folded position (shown in FIG. 3) wherein the extension member 52 rests on top of the seat bottom member 34, and an extended position (shown in FIG. 4) wherein the extension member 52 extends outwardly from the forward end 36 of the seat bottom member 34 and is substantially coplanar with the seat bottom member 34. In the preferred embodiment, the extension member 52 is pivotally connected to the seat bottom member 34 by a second hinge apparatus 58 (FIG. 5). The sofa/sleeper 26 further comprises at least one retractable leg 60 for supporting the extension member 52 in its extended position. Preferably, the sofa/sleeper 26 includes three legs 60. The legs 60 are shown retracted in FIGS. 2 and 3 and extended in FIG. 4.

The sofa/sleeper 26 further comprises a cover member or curtain board 62 suspended adjacent the forward end 36 of the seat bottom member 34. Preferably, as shown in FIG. 5, the curtain board 62 is suspended from the inner end 54 of the extension member 52 by a hinge apparatus 63. The curtain board 62 has hanging therefrom a decorative curtain 64.

Figure 3:
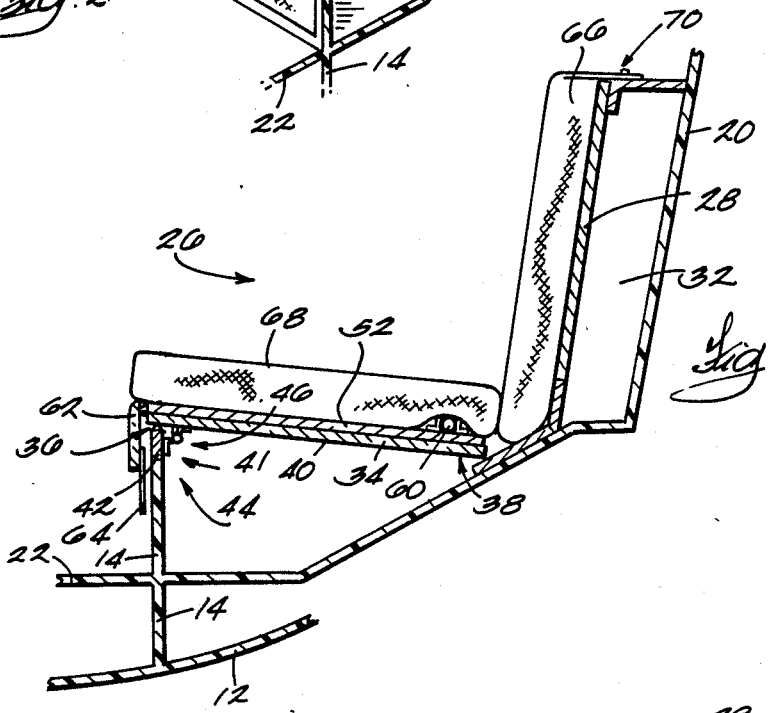
FIG. 3 is a vertical cross-sectional view of the sofa/-sleeper being used as a sofa.
Figure 4:
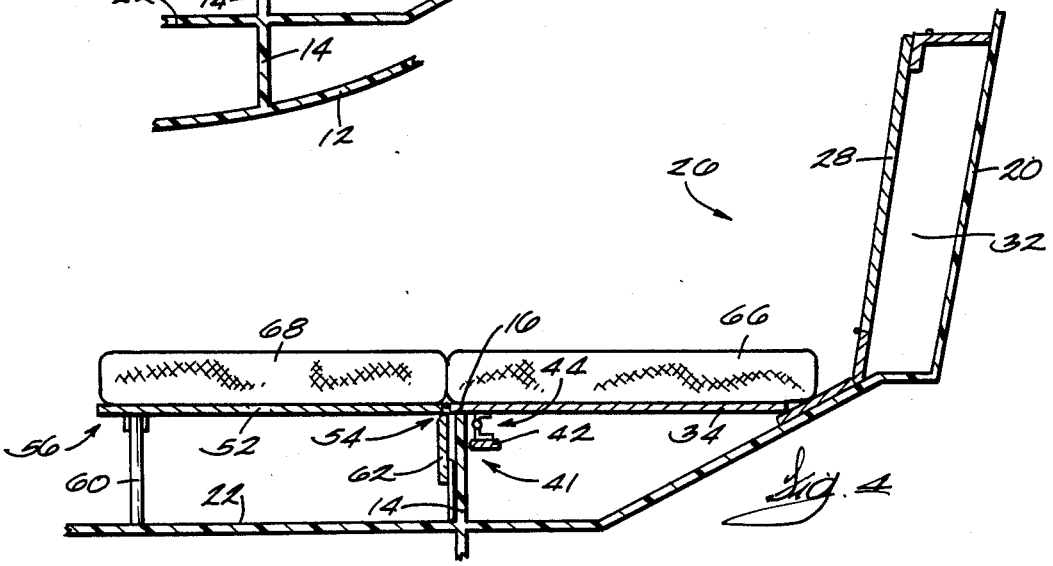
FIG. 4 is a vertical cross-sectional view of the sofa/-sleeper being used as a sleeper.

The sofa/sleeper 26 also comprises (see FIGS. 3 and 4) a seat back cushion 66 and a seat bottom cushion 68. When the sofa/sleeper 26 is being used as a sofa, as shown in FIG. 3, the seat back cushion 66 rests against the seat back member 28 and the seat bottom cushion 68 rests on top of both the extension member 52 and the seat bottom member 34. The seat back cushion 66 can be secured against the seat back member 28 by any suitable means, such as snaps 70 (FIG. 5). When the sofa/sleeper 26 is being used as a sleeper, as shown in FIG. 4, the seat bottom cushion 68 rests on top of the seat bottom member 34 and the seat back cushion 66 rests on top of the extension member 52.

Various features of the invention are set forth in the following claims.

I claim:

1. A marine vehicle comprising a hull, a support fixed relative to said hull, and a convertible sofa-sleeper supported by said hull and including a seat bottom member which is movable between a horizontal position wherein said seat bottom member extends substantially horizontally, and a canted position wherein said seat bottom member is inclined upwardly and which includes a perimeter and an under surface fixed against movement with respect to said seat bottom member and located within said perimeter and removably engageable with said fixed support to locate said seat bottom member in said horizontal position, and a support member connected to said seat bottom member and movable between a seat supporting position in engagement with said fixed support to locate said seat bottom member in said canted position with said outer end raised above the position thereof when said seat bottom member is in said horizontal position and a non-supporting position spaced from said supporting position and located wholly inwardly of said perimeter.

2. A marine vehicle as set forth in claim 1 wherein said support member is mounted on said seat bottom member for pivotal movement between said first and second positions.

3. A marine vehicle as set forth in claim 2 wherein said seat bottom member has an underside and wherein said support member is pivotally connected to said underside of said seat bottom member.

4. A marine vehicle as set forth in claim 1 and further comprising a hull stringer extending upwardly from said hull and having thereon said fixed support.

5. A marine vehicle comprising a hull, a support fixed relative to said hull, and a convertible sofa-sleeper supported by said hull and including a seat bottom member which is movable between a horizontal position wherein said seat bottom member extends substantially horizontally, and a canted position wherein said seat bottom member is inclined upwardly and which includes an outer end with an under surface removably engageable with said fixed support to locate said seat bottom member in said horizontal position, and an upper surface, a support member connected to said seat bottom member and movable between a seat supporting position in engagement with said fixed support to locate said seat bottom member in said canted position with said outer end raised above the position thereof when said seat bottom member is in said horizontal position and a non-supporting position spaced from said supporting position, and an extension member having an outer end and an inner end pivotally connected to said outer end of said seat bottom member for pivotal movement between a folded position wherein said extension member rests on said upper surface of said seat bottom member, and an extended position wherein said extension member extends outwardly from said outer end of said seat bottom member and is substantially coplanar with said seat bottom member.

6. A marine vehicle as set forth in claim 5 and further comprising a retractable leg for supporting said extension member in said extended position.

7. A marine vehicle as set forth in claim 5 and further comprising a cover member suspended from said inner end of said extension member.

8. A marine vehicle as set forth in claim 1 wherein said seat bottom member also has a rearward end, and wherein said sofa/sleeper also comprises a seat back member located adjacent said rearward end.

9. A convertible sofa/sleeper comprising a seat bottom member which is movable between a horizontal position wherein said seat bottom member extends substantially horizontally and a canted position wherein said seat bottom member is inclined, and which includes a perimeter and an under surface fixed against movement with respect to said seat bottom member and located within said perimeter and adapted to removably engage a fixed supporting surface to locate said seat bottom member in said horizontal position, and a support member connected to said seat bottom member and movable between a seat supporting position wherein said support member is adapted to engage the fixed supporting surface so as to locate said seat bottom member in said canted position and a non-supporting position spaced from said seat supporting position and located wholly inwardly of said perimeter thereby facilitating engagement of said under surface with the fixed supporting surface.

10. A sofa/sleeper as set forth in claim 9 wherein said support member is mounted on said seat bottom member for pivotal movement between said first and second positions.

11. A sofa/sleeper as set forth in claim 10 wherein said seat bottom member has an underside and wherein said support member is pivotally connected to said underside of said seat bottom member.

12. A convertible sofa/sleeper comprising a seat bottom member which is movable between a horizontal position wherein said seat bottom member extends substantially horizontally and a canted position wherein said seat bottom member is inclined, and which includes an outer end with an under surface adapted to removably engage a fixed supporting surface to locate said seat bottom member in said horizontal position, and an upper surface, a support member connected to said seat bottom member and movable between a seat supporting position wherein said support member is adapted to engage the fixed supporting surface and a non-supporting position spaced from said seat supporting position, thereby facilitating engagement of said under surface of said outer end with the fixed supporting surface, and an extension member having an outer end and an inner end pivotally connected to said outer end of said seat bottom member for pivotal movement between a folded position wherein said extension member rests on said upper surface of said seat bottom member, and an extended position wherein said extension member extends outwardly from said outer end of said seat bottom member and is substantially coplanar with said seat bottom member.

13. A sofa/sleeper as set forth in claim 12 and further comprising a retractable leg for supporting said extension member in said extended position.

14. A sofa/sleeper as set forth in claim 12 and further comprising a cover member suspended from said inner end of said extension member.

15. A sofa/sleeper as set forth in claim 9 wherein said seat bottom member also has a rearward end, and wherein said sofa/sleeper also comprises a seat back member located adjacent said rearward end.

* * * * *